United States Patent [19]

Kreisberg et al.

[11] Patent Number: 4,629,421

[45] Date of Patent: Dec. 16, 1986

[54] GAS AND SOLID PARTICULATE MATERIAL HEAT EXCHANGER

[75] Inventors: Alan J. Kreisberg; Jay Warshawsky, both of Allentown, Pa.

[73] Assignee: Fuller Company, Bethlehem, Pa.

[21] Appl. No.: 799,071

[22] Filed: Nov. 18, 1985

[51] Int. Cl.[4] ..... F27D 15/02; F27D 1/08; F26B 19/00; F26B 17/12

[52] U.S. Cl. ..... 432/77; 34/62; 34/168; 34/174; 432/100

[58] Field of Search ..... 432/14, 77, 96, 99, 432/100, 106; 34/62, 168, 169, 174

[56] References Cited

U.S. PATENT DOCUMENTS 2,834,119 5/1958 Schaub ..... 34/174

4,258,476 3/1981 Caughey ..... 34/174

*Primary Examiner*—Albert J. Makay

*Attorney, Agent, or Firm*—Frank H. Thomson

[57] ABSTRACT

A gas-solids heat/exchanger apparatus particularly designed for cooling the particulate material such as calcined limestone or cement clinker, but may also be used as a dryer and/or material heater. The apparatus includes a casing having an upper particulate material inlet and a lower particulate material outlet. Upper and lower grates extend on an angle or a slant from the inlet to the outlet for holding a bed of material. Gas is supplied to an inlet plenum chamber on one side of the lower grate for passage through the grates and the bed of material to an outlet plenum chamber. The lower grate is perforated to permit gas to pass therethrough while supporting the bed of material. The upper grate includes a plurality of spaced apart, vertically oriented, perforated slats. Various parameters or gas flow rates, pressure drops and positioning of the upper grate slats are disclosed.

14 Claims, 7 Drawing Figures

GAS AND SOLID PARTICULATE MATERIAL HEAT EXCHANGER

BACKGROUND OF THE INVENTION

This invention relates to an apparatus for carrying out heat exchange between a gas and solid particulate material. More particularly, the invention relates to an apparatus designed for cooling hot particulate material such as calcined lime or cement clinker discharges from a furnace such as a rotary kiln or fluid bed reactor, or from a primary cooler such as a grate or attached tube cooler. The apparatus may also be used as a dryer or preheater for solid particulate material.

Prior to the present invention, various types of heat exchangers for gas and solid particulate material are known including reciprocating grate type coolers for hot particulate material such as cement clinker discharged from a rotary kiln; attached tube coolers for burnt lime and cement clinker discharged from a rotary kiln; and various types of shaft heat exchangers for either preheating or cooling solid particulate material. Also known are inclined type heat exchangers as shown in U.S. Pat. Nos. 4,255,130 and 4,255,131 for preheating material to be supplied to a kiln. Cross current type heat exchangers are also known and shown for example in U.S. Pat. No. 3,284,072 and U.S. patent application, Ser. No. 06/596,882 filed Apr. 5, 1984, and assigned to the assignee of the present application.

Material heat exchangers of the type which confine a bed of material between two grates have the advantage of being able to control the pressure drop of the gas across the bed of material because the depth of material can be maintained. Many prior devices of this type have the disadvantage that they are not capable of handling various size materials.

Fines will tend to migrate towards each other causing a region of decreased porosity and resultant increased pressure drop. Many devices of this type may not be able to handle oversized particles.

As gas is passed through a bed of material, fine particles will gravitate to the top. If the top of the bed of material is confined as in prior apparatus, when the fines move to the top, because the fines will be more tightly packed, there will be less space between them than between the coarse particles. This tighter spacing will cause an increase in the pressure drop across the bed of material. According to the present invention the top of the bed of material is allowed to expend to thereby eliminate the increase in pressure drop experienced by prior apparatus.

SUMMARY

It is a principal object of this invention to provide a heat exchanger apparatus for gas and solid particulate material which is capable of use as a material cooler or preheater for solid particulate material and capable of handling a range of particle sizes at a low pressure drop.

It is a further object of this invention to provide an apparatus wherein the material flow is maintained by gravity without requiring mechanical transport devices such as reciprocating grates, drag chains, or vibrating conveyors.

In general, the foregoing and other objects will be carried out by providing an apparatus for carrying out heat exchange between a gas and solid particulate material comprising an upper inlet for particulate material and a lower outlet for particulate material; a lower grate mounted in said casing extending from the said upper inlet to said lower outlet for supporting a bed of particulate material for movement from the inlet to the outlet along the lower grate; means defining an upper grate mounted in said casing and spaced from said lower grate including a plurality of generally vertically oriented slats, each spaced from and positioned below a preceding slat in the direction from said inlet toward said outlet for defining the top of the bed of material while permitting the bed of material to expand; said casing including an inlet for gas on one side of the casing and an outlet for gas on the other side of the casing whereby gas flows from said inlet through said lower grate, the bed of material and through the upper grate to the outlet for gas for carrying out heat exchange between the gas and the solid particulate material.

According to the present invention, finely divided material, preferably less that 2 inches in size is fed directly to the top of the unit from the outlet of a furnace or by a conveyor from a furnace or primary cooler. The material enters the unit into a material holding or surge section. The material level in this surge section is controlled by a discharge feeder at the bottom or outlet of the unit.

Material passes down through the cooler by gravity flow between an upper grate and a lower grate, with the lower grate being positioned at an angle greater than the angle of repose of the material up to 90° from horizontal. The lower grate may be made from a perforated plate or screen and allows air to pass up through it while supporting the bed of material.

The upper grate is constructed of spaced apart and overlapping slats arranged to allow air to pass through while retaining the bed of material. In the preferred form, the angle formed between the bottoms of the overlapping slats is the same as or slightly less than the angle of the lower grate forms with the horizontal. Material builds up against the vertical walls of the slats to the angle of repose of the material. The top grate is designed to form the top to the bed of material, but allows the gas to pass through and fine material to pass through and fall by gravity to the bottom of the unit. The slats of the upper grate maybe solid, but in the preferred form are gas permeable and constructed of a screen, perforated plate or parallel bars which have openings large enough to allow air and fine material to pass through while retaining the top of the bed of material. With the upper grate in the configuration of the present invention, the top of the bed of material is allowed to expand between the slats so that fines are not confined by the upper or second grate and packed. As a result, the present invention eliminates the increase in pressure drop across the bed of material which is normally encountered in prior apparatus.

Gas for heat exchange for either cooling or heating material passes through the bed of material generally perpendicular to the flow of material. The air velocity through the bed is between 100 and 400 feet per minute. In the preferred form, the pressure drop across the bed is maintained at less that 12 inches water gauge (INWG). The gas can be introduced by means of a pressure fan or air flow can be induced by suction at the outlet.

BRIEF DESCRIPTION OF THE DRAWINGS

The invention will be described in connection with the annexed drawings wherein.

DESCRIPTION OF THE PREFERRED EMBODIMENT

The invention will be described as a material cooling device, but it should be understood that the heat exchanger of the present invention is also capable of being used as a material dryer or preheater or any other apparatus where it is desired to achieve gas and solid particulate material contact.

Figure 1:
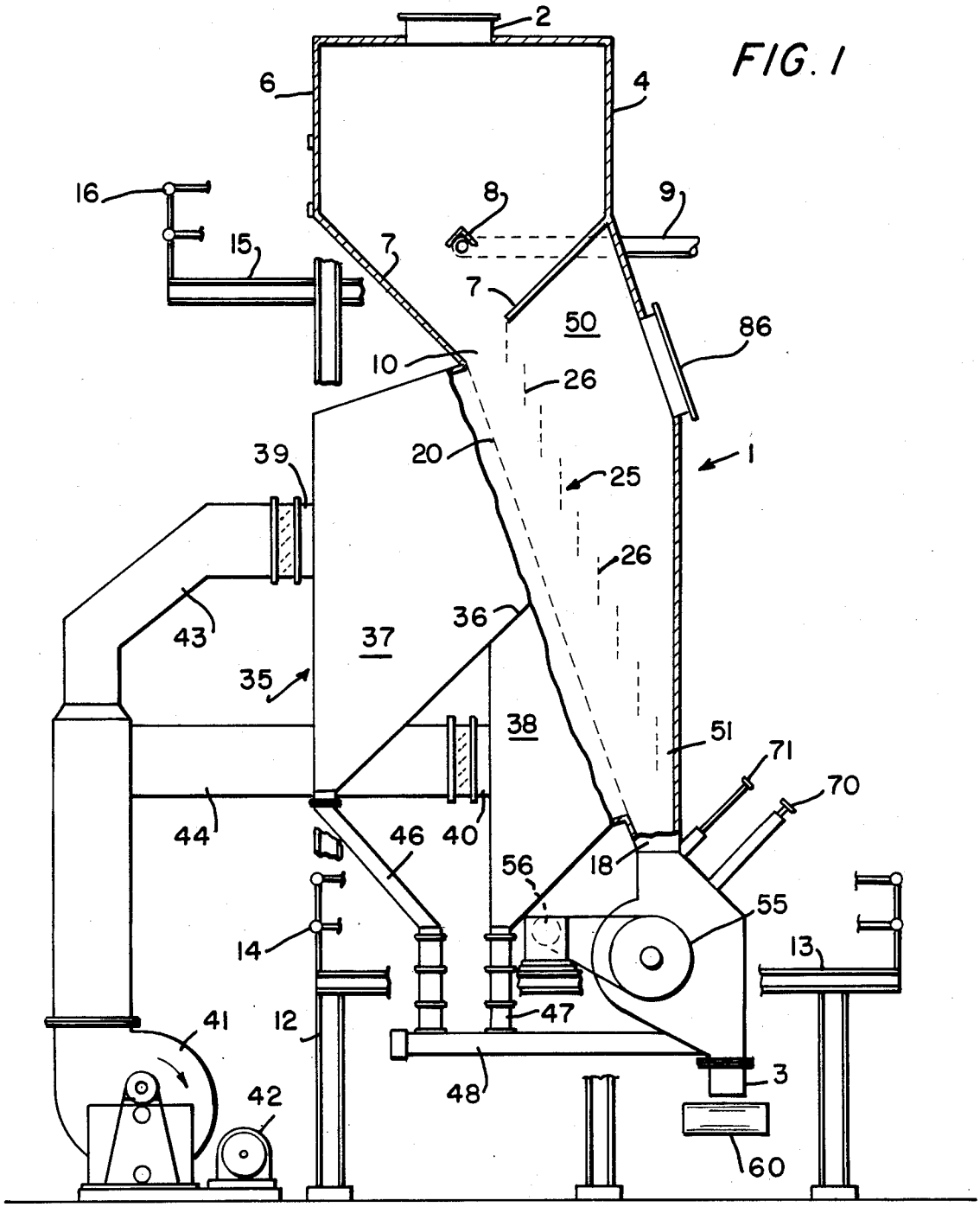
FIG. 1 is an elevation view of the heat exchanger according to the present invention.

Referring to FIG. 1, there is shown a casing 1 having an upper inlet 2 for solid particulate material and a lower outlet 3 for solid particulate material. As a cooler, the inlet through 2 will receive hot particulate material either from a furnace such as a rotary kiln or from a preliminary cooler and the outlet 3 will discharge cooled material.

Immediately below the inlet 2, the casing defines an upper material hopper 4 formed by side walls 6 and bottom walls 7. This hopper may include a distributor member 8 and a cooling air supply line 9. At the bottom of the hopper 4 there is a material outlet 10 which forms the solid particulate material inlet of the heat exchange apparatus.

The casing 1 is supported by a frame 12 which may include a work platform 13 having handrails 14. An upper work platform 15 having handrails 16 may also be provided.

A lower or first grate 20 is mounted in the casing and extends from the inlet 10 for solid particulate material to an outlet 18. The grate 20 is mounted at an angle to horizontal between the angle of repose of the material and 90° to horizontal. In the preferred embodiment, this lower grate 20 is set at an angle between 50° and 70° from the horizontal. The grate 20 is formed by a perforated gas distributor which has openings sufficiently small to support a bed of particulate material between the inlet 10 and outlet 18 and sufficiently large to allow gas to pass therethrough for heat exchange with the solid particulate material. In the preferred form, the grate 20 has an open area of between 10 and 40%. For example, the grate may be made of a perforated plate having ¼ inch holes with 40% open area or ½ inch holes with 10% open area.

Also mounted within the casing is a means 25 defining an upper grate. The upper grate 25 includes a plurality of generally vertically oriented spaced apart slats 26. In the preferred form, these slats overlap each other with each slat being spaced from and positioned below a preceding slat in the direction from the inlet 10 to the outlet 18.

Figure 3:
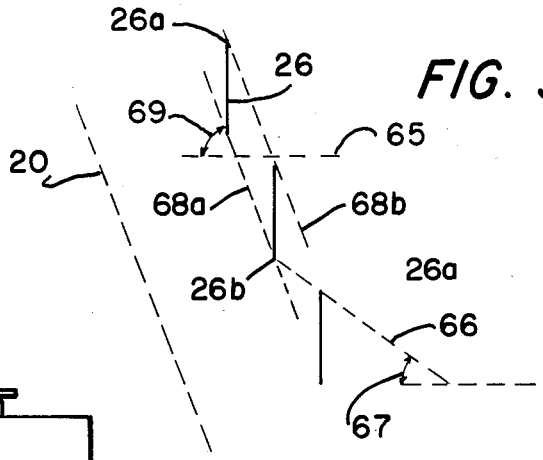
FIG. 3 is a diagrammatic view showing a portion of the upper grate according the present invention.

As shown in FIG. 3, the vertical slats 26 are positioned such that a line 68*a* drawn between the top or upper ends 26*a* of adjacent slats and a line 68*b* drawn between the bottom or lower end 26*b* of adjacent slats are, in the preferred form, parallel to the first or lower grate 20. These lines 68*a* and 68*b* form an angle 69 to the horizontal (65). The slats are further located to retain the material laying in its normal angle of repose. Accordingly, in the preferred form, a line 66 drawn from the bottom 26*b* of an upper slat to the top 26*a* of a lower slat will form an angle with horizontal (65) which is less than or at most approximately equal to the angle of repose 67 of the particulate material being treated.

Figure 4:
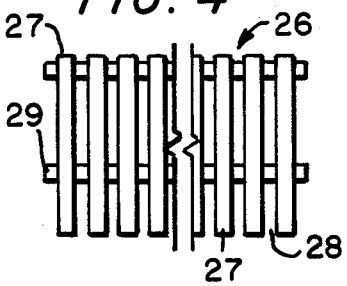
FIGS. 4 to 6 are views of embodiments of the upper grate sections.
Figure 5:
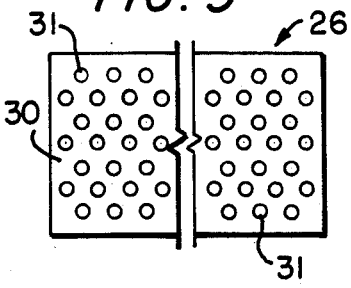
Figure 6:
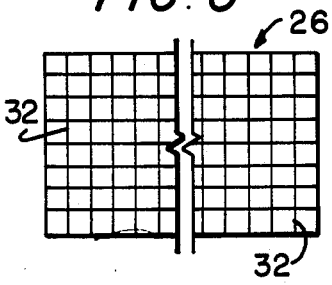

Each of the slats 26 may be in the form shown in FIGS. 4–6. In FIG. 4, the slats consist of a plurality of vertically oriented bars 27 which define spaces 28 therebetween and are mounted on support bars 29. In FIG. 5, the slat 26 consists of a perforated plate 30 having a plurality of spaced apart openings 31 therein. In the embodiment of FIG. 6, the slat 26 is formed by a screen 32.

The casing 1 defines an inlet plenum 35 adjacent the lower grate 20 which in the embodiment illustrated in FIG. 1 is divided by a partition 36 into an upper compartment 37 and a lower compartment 38. In some embodiments, it may not be necessary to use the partition 36 whereas in other embodiments it may be necessary to divide the lower or inlet plenum 35 into more than two compartments. The compartment 37 includes an inlet 39 for gas and the compartment 38 has an inlet 40 for gas which together, define the inlet for gas of the casing. In the embodiment illustrated, a fan 41 driven by suitable means 42 supplies cooling air through ducts 43 and 44 to the inlets 39 and 40, respectively of the compartments 37 and 38, respectively. The compartments 37 and 38 form dropout chambers which are flow connected by ducts 46 and 47 to a screw conveyor 48 for supplying material which may fall through the grate 20 to the outlet 3 of the apparatus. If the heat exchanger of the present invention is to be used as a material preheater or dryer, the compartments 37 and 38 would be connected to a source of hot gas such as the exhaust from a furnace for processing the particulate material.

The casing 1 also defines an outlet plenum chamber 50 on the side of upper grate 25 opposite the inlet plenum chamber 35. A gas outlet 86 is positioned in the outlet plenum.

Figure 2:
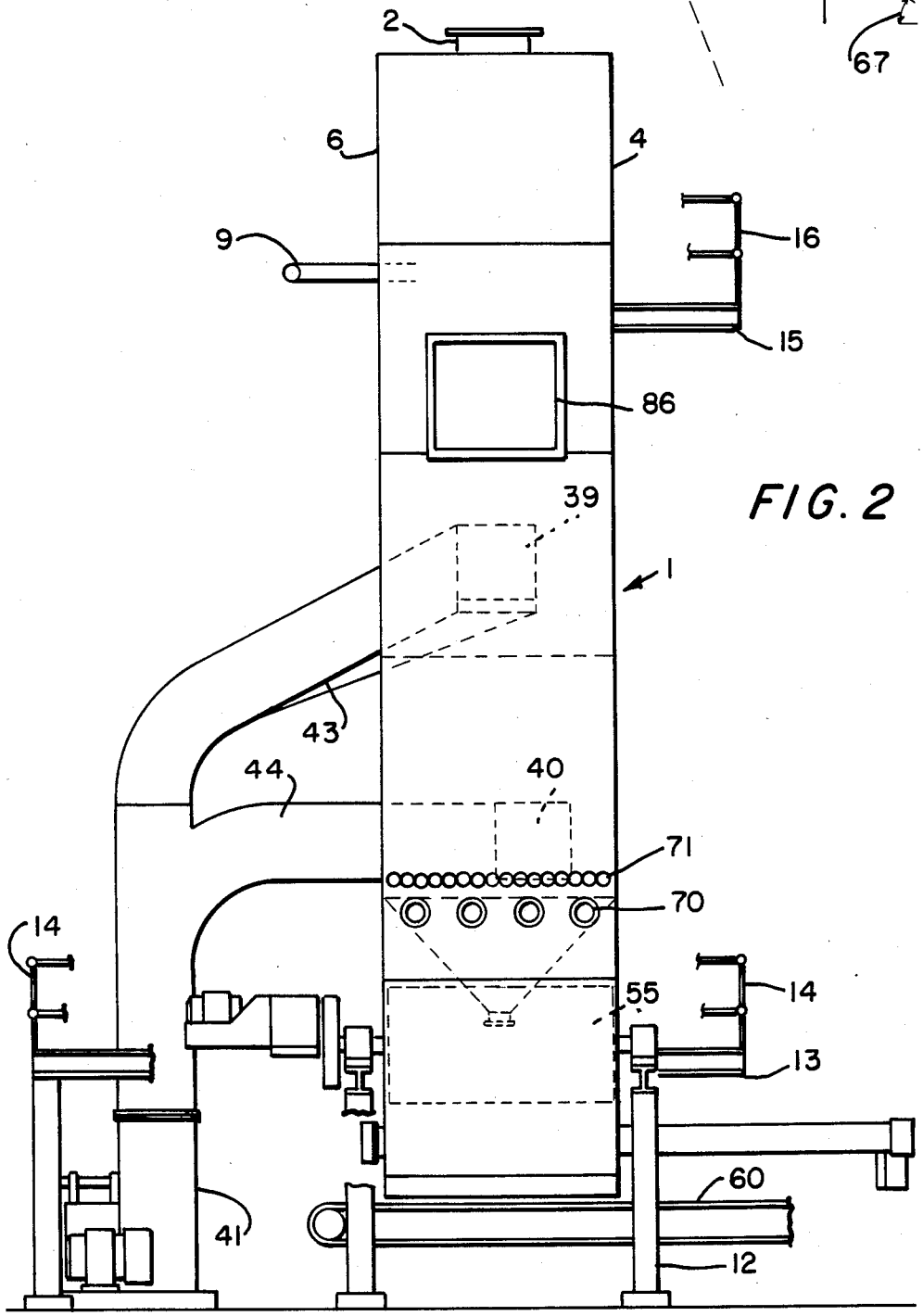
FIG. 2 is an end view of the heat exchanger according to the present invention.

The apparatus also includes a suitable means for controlling the flow of material through the outlet 18 to the outlet 3. In the form illustrated in FIGS. 1 and 2, this means is a drum feeder 55 generally known in the art. Other apparatus such as the push feeder 155 shown in FIG. 7 may be used. This feeder 55 may be driven by any suitable motor or hydraulic drive means 56. In operation of the apparatus, the discharge rate of the feeder 55, is controlled and in general if the feeder 55 is moved faster, material will flow faster from inlet 10 to outlet 18. Material discharged from outlet 3 is conveyed away from the apparatus by a suitable conveyor 60. If the apparatus is used as a preheater, the outlet 3 will be directly connected to the inlet of the processing furnace.

In operation, a bed of material is supported on grate 20 with the upper grate 25 confining the top of the bed of material. Gas to be in contact with the bed of particulate material is passed through ducts 43 and 44 to inlets 39 and 40 and compartments 37 and 38 to pass through the lower grate 20, the bed of material formed on the grate 20 between the upper and lower grates and the upper grate means 25 to compartment 50 and outlet 86. The material falls by gravity from the inlet 10 to the outlet 18. In the preferred arrangement, the gas velocity through the bed is maintained on the order of between approximately 100 and 400 feet per minute. Fine material which may be in the bed of material may be carried out through the second grate means 25 into the compartments 50. The compartment 50 is dimensioned with an adequate area to permit the gas velocities to decrease such that most of the fine particles which are carried out of the bed of material settle down to the bottom 51 of the compartment 50. From there, the fine material will fall into the feeder 55.

With the present invention, the second or upper grate means 25 does not rigidly confine the bed of material but instead allows the bed to expand. This is particularly important when the particulate material contains a range of particle sizes including coarse material and fine material. In such an application, as material moves from the inlet toward the outlet and air is passed therethrough, the fine particles tend to move toward the top of the bed. If the top of the bed is confined as with prior devices, the segregation of the fines will result in an increased pressure drop. With the present invention, the upper grate 25 allows the bed of material to expand. This means that while the fines will still move to the top of the bed, the pressure drop across the bed will not increase to the extent of the prior art.

In the preferred arrangement, air which is heated by contact with the hot bed of material may be exhausted from outlet 86 into the furnace as secondary or tertiary combustion air. In an alternate arrangement, the heated air may be exhausted to a dust collector or other equipment where the heat can be used.

The apparatus may include suitable poke hole means 70 and 71 to provide access whereby plugs of material in the outlet 18 can be broken up.

According to the present invention the discharge or drum feeder 55 must be designed to withdraw material across the entire width of the cooler. This may be done by using a feeder as wide as the heat exchanger or by designing a mass flow hopper under the cooler which draws material evenly over the entire width of the cooler.

While the cooler has been illustrated with only a single pass of cooling air, a second stage unit may be placed below the grates 20 and 25 angled in the opposite direction to provide a stepped arrangement. In such an embodiment, the gas for heat exchange may be passed serially, first through one bed of material and then through the second bed of material.

While in the form illustrated, the upper grate 25 has been shown to be at substantially the same angle as the lower grate 20, in some applications it may be desirable to have the two grates at different angles. Thus, if upper grate 25 is more vertical than lower grate 20, the bed of material between the grates will be deeper at the inlet than at the outlet. If the upper grate 25 is at a lesser angle to horizontal than grate 20, a deeper bed will be formed at the outlet end of the apparatus. In still other applications it may be desirable to have the grate 25 at two different angles along its length, so that a deep bed of material is formed in the center of the cooler.

Figure 7:
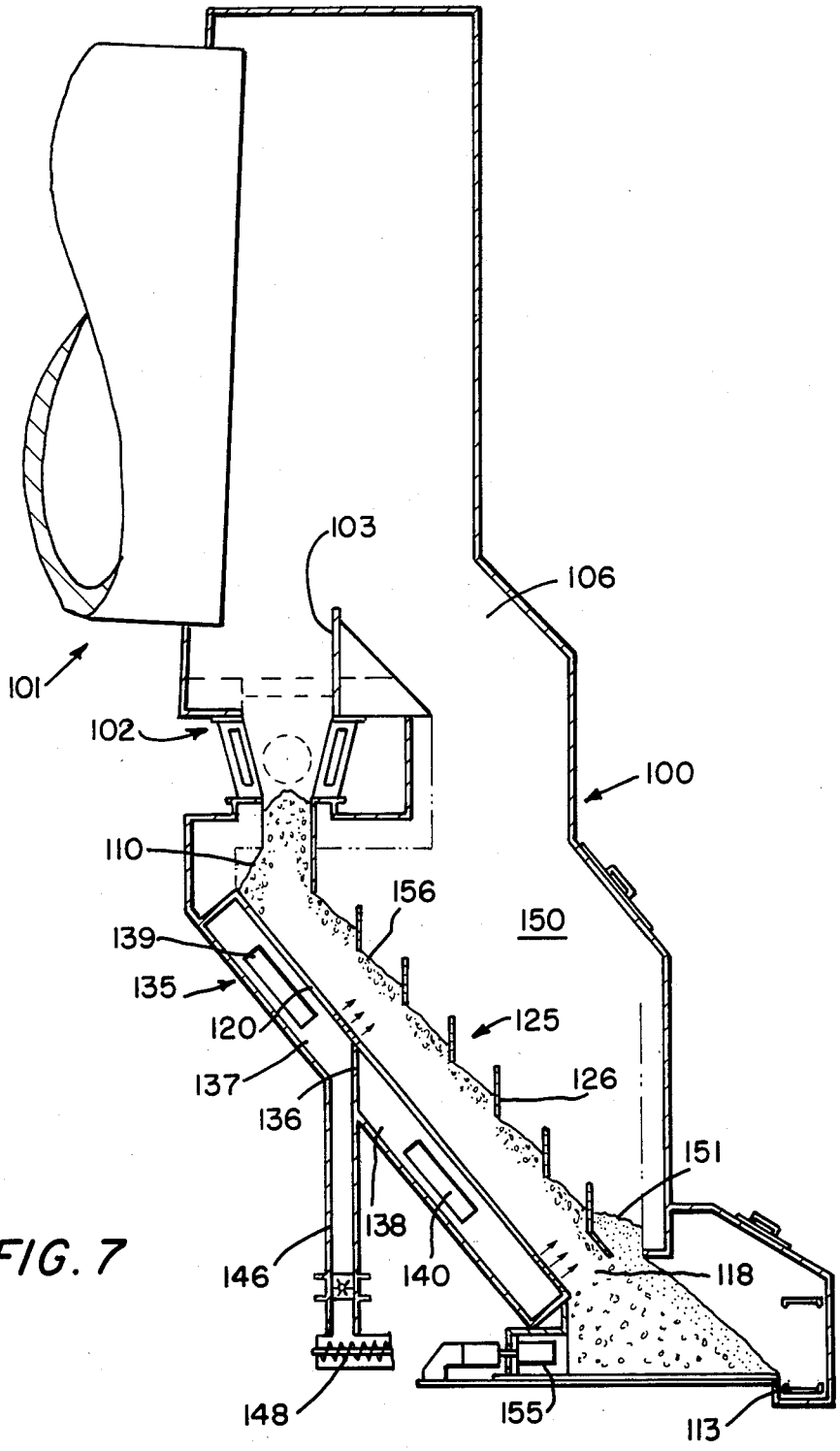
FIG. 7 is a sectional view of a modified apparatus according to the present invention used as a cooler for receiving material discharged from a rotary kiln.

A further embodiment of the present invention is shown in FIG. 7 wherein the heat exchanger is utilized as a material cooler 100 in combination with a furnace such as a rotary kiln generally indicated at 101. The kiln will include a burner (not shown). In this embodiment, hot material such as calcined lime is discharged from the kiln 101 to a lump breaker diagrammatically indicated at 102 which may be of a type known per se in the art. A side plate 103 serves to guide material into the breaker 102. The cooler 100 includes an inlet 110 for hot material flow connected to the outlet of the kiln 101 by way of the breaker 102. A lower or first grate 120 extends between the inlet 110 and the outlet 118 for cooled material and may be in the form illustrated in FIGS. 1 and 2. An upper or second grate 125 in the form of the grate of FIGS. 1 to 6 including slats 126 is mounted in the cooler. Means defining a lower or inlet plenum chamber 135 is provided adjacent the grate 120 and includes inlets 139 and 140 flow connected to a source (not shown) of cooling air. The plenum chamber 135 may be divided by partition 136 into compartments 137 and 138 in the manner of FIG. 1. As in FIG. 1, the compartment 137 may include a conduit 146 and screw conveyor 148 to supply material which falls through grate 120 to the outlet conveyor. In the embodiment illustrated in FIG. 7, the drum feeder 55 of FIGS. 1 and 2 has been replaced by a reciprocating pusher 155 known per se for moving material from the outlet 118 to the outlet of the cooler 100 and conveyor 113.

In the operation of the cooler of FIG. 7, hot material is discharged from kiln 101 into the area between grates 120 and 125 to form a bed of material 156 which will move by gravity from inlet 110 to outlet 118. Ambient air is supplied through inlets 139 and 140 and plenum chamber 135 for passage through first grate 120, the bed of material 156 and second grate 125 to the outlet compartment 150. As the air passes through the material, the hot material is cooled and the air is heated. The thus heated air is then supplied through cooler outlet 106 to the kiln 101 to serve as combustion air in the kiln to thereby improve fuel consumption of the process.

If desired, a grizzly may be placed in the outlet 106 to prevent coarse material from entering the chamber 150 in the event of a flush of material from the kiln which is not caught by plate 103. Also in the event of a material flush, the speed of the outlet device 155 can be increased to avoid material build up at the inlet 110 to increase the rate at which material is removed from the device.

As material moves from the inlet to the outlet and cooling air is passed through the bed of material, the bed 156 will expand to keep pressure drop substantially constant along the length of the bed. Fine material which moves to the top of the bed may be carried out through the grate 126. The expanded chamber 150 will cause the fines to drop out and fall to the bottom of chamber 150 as shown at 151.

From the foregoing it should be apparent that the objects of this invention have been carried out. It is intended however that the invention be limited solely by that which is within the scope of the appended claims.

We claim:

1. Apparatus for carrying out heat exchange between a gas and solid particulate material comprising a casing having an upper inlet for particulate material and a lower outlet for particulate material; a lower grate mounted in said casing extending from said upper inlet to said lower outlet for supporting a bed of particulate material for movement from the inlet to the outlet along the lower grate; means defining an upper grate mounted in said casing and spaced from said lower grate including a plurality of generally vertically oriented slats, each spaced from and positioned below a preceding slat in the direction from said inlet toward said outlet for defining the top of the bed of material while permitting the bed of material to expand; said casing including an inlet for gas on one side of the casing and an outlet for gas on the other side of the casing whereby gas flows from said inlet through said lower grate, the bed of material and through the upper grate to the outlet for gas for carrying out heat exchange between the gas and the solid particulate material, said slats being spaced apart from each other by a distance sufficient to hold the bed of material on the lower grate while allowing gas and fine material to pass therethrough; said casing being dimensioned so that the velocity of gas which has passed through the upper grate decreases by an amount to permit at least some of the fine material which passes through the upper grate to fall by gravity to the bottom of the casing.

2. Apparatus for carrying out heat exchange between a gas and solid particulate material comprising a casing having an upper inlet for particulate material and a lower outlet for particulate material; a lower grate mounted in said casing extending from said upper inlet to said lower outlet for supporting a bed of particulate material for movement from the inlet to the outlet along the lower grate; means defining an upper grate mounted in said casing and spaced from said lower grate including a plurality of generally vertically oriented slats, each spaced from and positioned below a preceding slat in the direction from said inlet toward said outlet for defining the top of the bed of material while permitting the bed of material to expand; said casing including an inlet for gas on one side of the casing and an outlet for gas on the other side of the casing whereby gas flows from said inlet through said lower grate, the bed of material and through the upper grate to the outlet for gas for carrying out heat exchange between the gas and the solid particulate material, said lower grate extends from said inlet for particulate material to the outlet for particulate material at an angle; each of said slats has a bottom and a top and the angle to horizontal of a line drawn between the bottom of adjacent slats is equal to or slightly less than angle of the lower grate.

3. Apparatus for carrying out heat exchange between a gas and solid particulate material according to claim 2 wherein a line drawn between the bottom of a slat and the top of an adjacent, lower slat forms an angle to horizontal approximately equal to or greater than the angle of repose of the solid particulate material.

4. Apparatus for carrying out heat exchange according to claim 3 wherein each of said slats is perforated to permit gas and fine material to pass therethrough while retaining the bed of material on the lower grate.

5. Apparatus for carrying out heat exchange accordingly to claim 4 wherein each of said slats is constructed of a screen.

6. Apparatus for carrying out heat exchange according to claim 4 wherein each of said slats is constructed of parallel bars.

7. Apparatus for carrying out heat exchange according to claim 3 wherein the gas is supplied to said casing for passage through the bed of material at a velocity of between 100 and 400 feet per minute.

8. Apparatus for carrying out heat exchange according to claim 7 wherein the lower grate is mounted at an angle to horizontal between the angle of repose of the particulate material at 90°.

9. Apparatus for carrying out heat exchange according to claim 8 wherein said casing includes at least one dropout chamber for collecting material which falls through said lower grate.

10. Apparatus for carrying out heat exchange according to claim 2 further comprising a discharge feeder mounted on said casing at the outlet for particulate material for controlling the flow of material through the apparatus.

11. Apparatus for carrying out heat exchange according to claim 10 wherein the lower grate is positioned at an angle of between 50° and 70° to horizontal.

12. Apparatus for carrying out heat exchange according to claim 11 wherein the pressure drop across the lower grate, bed of material and upper grate is maintained at less than 12 INWG.

13. Apparatus for carrying out heat exchange according to claim 11 wherein the lower grate has an open area of between 10 and 40%.

14. Apparatus for carrying out heat exchange between a gas and solid particulate material comprising a casing having an upper inlet for particulate material and a lower outlet for particulate material; a lower grate mounted in said casing extending from said upper inlet to said lower outlet for supporting a bed of particulate material for movement from the inlet to the outlet along the lower grate; means defining an upper grate mounted in said casing and spaced from said lower grate including a plurality of generally vertically oriented slats, each spaced from and positioned below a preceding slat in the direction from said inlet toward said outlet for defining the top of the bed of material while permitting the bed of material to expand; said casing including an inlet for gas on one side of the casing and an outlet for gas on the other side of the casing whereby gas flows from said inlet through said lower grate, the bed of material and through the upper grate to the outlet for gas for carrying out heat exchange between the gas and the solid particulate material, each of said slats is perforated to permit gas and fine material to pass therethrough while retaining the bed of material on the lower grate.

* * * * *